United States Patent [19]

Delaroche et al.

[11] Patent Number: 4,694,144

[45] Date of Patent: Sep. 15, 1987

[54] DOUBLE-GLAZED FRAME HAVING AN INTERNAL TUBULAR BLIND

[76] Inventors: Pierre Delaroche, 3, rue Granvelle, 25000 Besancon; Paul Depondt, 3, rue des Chênes Pourpres, 95000 Cergy, both of France

[21] Appl. No.: 755,729

[22] Filed: Jul. 17, 1985

[51] Int. Cl.[4] ..... E06B 9/24; H05B 3/06

[52] U.S. Cl. ..... 219/522; 219/203; 160/84 R

[58] Field of Search ..... 219/203, 520, 522, 543; 160/84 R, 107; 52/171

[56] References Cited

U.S. PATENT DOCUMENTS

| | | | |
|---|---|---|---|
| 2,625,640 | 1/1953 | Gaisen et al. | 219/522 |
| 3,710,074 | 1/1973 | Stewart | 219/203 |
| 4,307,768 | 12/1981 | Anderson | 160/84 R |

FOREIGN PATENT DOCUMENTS

| | | | |
|---|---|---|---|
| 4455 | 10/1979 | European Pat. Off. | 160/84 R |
| 607788 | 9/1982 | European Pat. Off. | 160/107 |
| 2840023 | 3/1980 | Fed. Rep. of Germany | 160/84 R |

*Primary Examiner*—E. A. Goldberg
*Assistant Examiner*—C. M. Sigda
*Attorney, Agent, or Firm*—Murray and Whisenhunt

[57] ABSTRACT

A double-glazed window frame comprising two parallel glass panes has an internal blind disposed between the glass panes in parallel therewith. The internal blind comprises a succession of collapsible elongated tubular volumes formed from a plurality of plastic strips; each plastic strip having a center section, an upper face, a lower face, an edge adjacent one of said glass panes and another edge adjacent the other of said glass panes; with the plastic strips alternately bonded to one another through the center section and through the two edges. Each plastic strip has a metallic layer deposited on each face thereof, and each metallic layer has a break in continuity between the edge adjacent one of the glass panes and the edge adjacent the other of the glass panes, whereby the coefficient of thermal insulation of the blind is improved.

10 Claims, 4 Drawing Figures

DOUBLE-GLAZED FRAME HAVING AN INTERNAL TUBULAR BLIND

The object of the invention is a doubleglazed frame intended for separating an outside environment from an inside environment, including an internal blind of tubular type the design of which significantly improves the coefficient of thermal insulation and in addition enables any disagreeable cold-wall effect to be easily eliminated, such as is usually produced by any glazed surface, even doubleglazed.

The tubular blind is a blind which exihibits, because of is construction, a succession of elongate volumes extending in parallel between the two panes of a frame. These volumes may follow one another in the vertical direction when the blind is in a state of use, with only one row in the horizontal direction; it is also possible for the blind to comprise in the horizontal direction a number of rows of tubular volumes joined side by side which follow one another, likewise joined together, in the vertical direction. In U.S. Pat. No. 4,307,768 will be found a complete description of a blind of this type produced by means of strips joined together by an adhesive.

The idea is also known of making use of strips of plastics matter covered with a layer of powdered metal.

In accordance with an important characteristic of a blind in accordance with the invention, on each of the faces of each of the strips which form the blind, there exists a break in the continuity of the metallic layer between the opposite edges of these strips, which are situated on the one hand next the outside environment and on the other hand next the inside enviroment, separated by the frame; this break in the continuity exists over the whole length of each strip.

It is preferable to provide this break in the continuity in the portion of each strip, which is central in the direction of its width. In general, in this central portion there is a zone of adhesion of each of the strips which bound one tubular volume to one of the strips which bound the tubular volume immediately above or below in the vertical direction. The break in the continuity then coincides with the zone of adhesion of the faces which are glued together.

When the blind comprises a number of tubular volumes in succession in the horizontal direction in accordance with a preferred embodiment of the invention, a break in continuity is provided at each of the zones of adhesion which are spaced apart in the direction transverse to the blind; this break is effected not only on the faces of the strips which are stuck together but also on the opposite faces corresponding with the gluing zones.

In accordance with the method of the invention for manufacturing such a tubular blind, a sheet of plastics matter is employed, which has been metallized on both faces by a deposit of a layer of a metal which reflects, in general, of aluminium; strips of suitable width having the required length are then cut out from this sheet, the metallic layer on both faces of the sheet corresponding with the intended zones of adhesion is then eliminated, and then the strips are joined by gluing carried out along gluing zones corresponding with the desired configuration of the blind.

The foregoing refers to the case where the metallic layer previously existing on the sheet of plastics matter is eliminated from the said zones by a suitable operation.

The invention also embraces the case where the metallic layer is not effected in certain zones, for example, by means of a mask or by the use of a protective matter which is easy to eliminate subsequently, at the time when the sheet of plastics matter is being covered with the reflecting metal layer. Within the frame of the method defined above, these sheets are used in order to cut out strips from them so as to employ as gluing zones at least certain of the zones which have been deprived of the metalic layer.

Whatever the way in which it is achieved, the break in the continuity of the metallic coating in the direction transverse to the blind is a characteristic which appears as unexpected and surprising result: the coefficient of thermal insulation of a blind in accordance with the invention is significantly improved; for example, it has been found on a double-glazed frame containing a conventional blind having a coefficient of calorific dissipation (loss) of 0.70 $W/m^2/°C$. that this coefficient reaches the value of 0.55 $W/m^2/°C$. when the blind is produced in accordance with the invention.

In addition, whatever the configuration of the tubular volumes of the blind, there exists on one face of any first elongated strip a metallic layer which is insulated electrically from the layer deposited on the opposite face of this strip and from the layers deposited on the strips to which this first strip is joined. It has been found that such an electrically insulated layer has over a width of 23 mm and over a length of 10 cm an electrical resistance of 10 ohms.

For a double-glazed frame containing a blind in accordance with the invention, having a total area of 2.50 $m^2$ (for example, a height of 2.50 m with a width of 1 m), with a difference in temperature of about 30° C. between one side of this frame and the other, the heat loss is of the order of 40 W. By making an electric current flow in the metallic layer of only one strip, along a length of 10–15 cm and at a voltage of 24 V, for example, the dissipation of an electrical power of 40 W is easily obtained inside the double-glazed frame. Hence in this way the loss which would occur through the latter is eliminated and the cold-wall effect which would result from it is made to disappear.

In a frame in accordance with the invention it is advantageous to provide at least one pair of spring blades arranged so as to come into electrical contact with two contact surfaces on one and the same strip forming part of a tubular volume of the blind, preferably with the lower face of one strip of the lowest tubular volume, the contact between these blandes and the said strip being effected when the blind is in the lowered position.

The spring blades preferably form part of an electrical circuit extending outside the frame in order to be connected to a suitable source of electric current and comprising also a thermostat connected to a temperature detector fixed, for example, to the inside panel of the double-glazed frame. This thermostat may cause the flow of current when the temperature of the inside panel becomes less than a predetermined value, for example, 19° C.

The spring blades may occupy a fixed position in order to be met by the blind when it reaches the bottom when lowered. It is also possible to mount the blades on a moving blade-carrier which can be moved from the outside of the frame in order that the electrical contact may be made or broken at will when the blind has been lowered. In this case the moving blade-carrier may be provided with a number of pairs of contact blades intended for becoming applied, each against a corresponding strip of a number of tubular volumes of the blind.

In a preferred embodiment of the invention the tubular volume or volumes which are bounded by a strip intended for coming into contact with the electrical blades, contain a rigid loading bar which ensures an electrical contact of better quality between the strip or strips and the pair or pairs of electrical blades.

Without restrictive intention and without excluding any variant, a description of an embodiment will now be given. Reference will be made to the accompanying diagrammatic drawings, in which.

Figure 1:
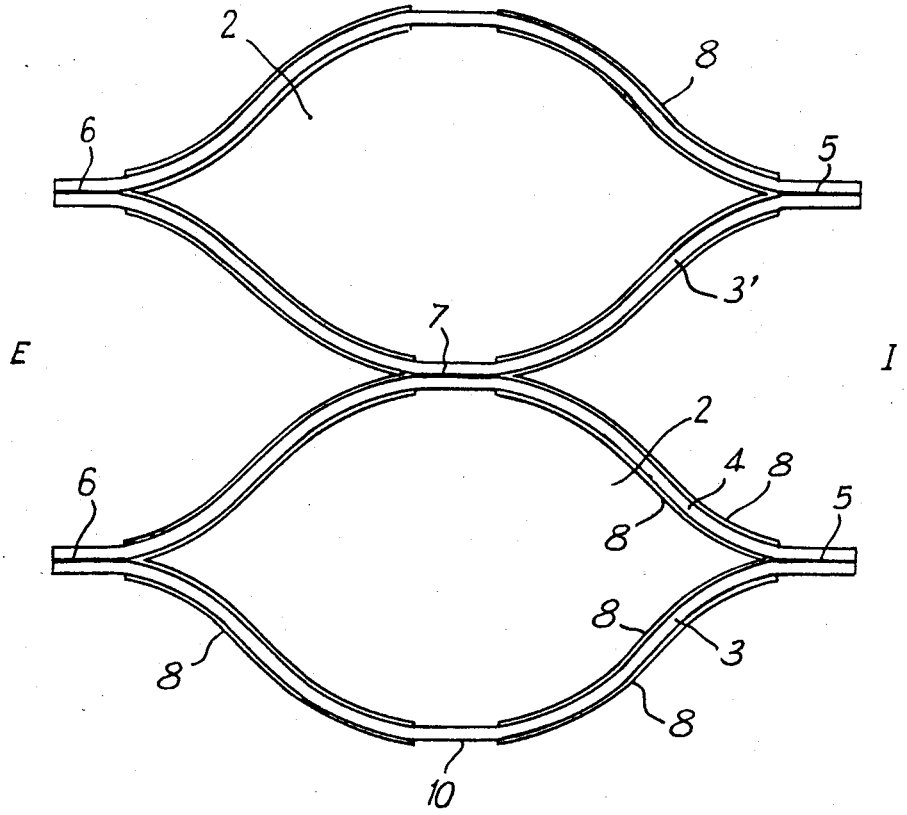
FIG. 1 is a partial enlarged section through a transverse plane of one portion of a blind in accordance with the invention.
Figure 3:
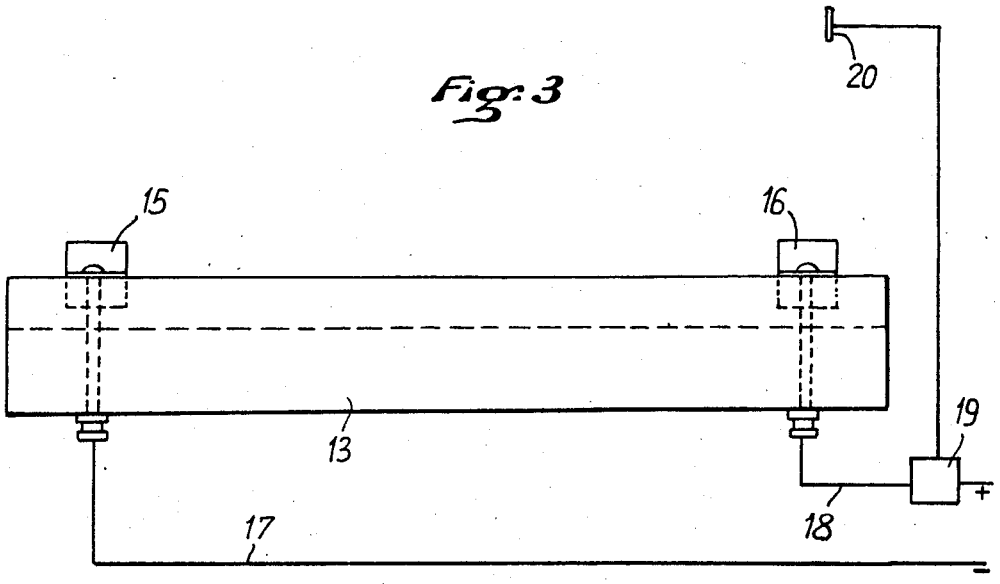
FIG. 3 is a partial view in the direction F of the frame in FIG. 2 showing the two electrical blades and the diagram of the electrial circuit.

FIG. 1 shows one portion of a blind composed of a succession of approximately tubular volumes 2 joined together in the vertical direction. Each tubular volume 2 is obtained by means of a first lower strip 3 and a second upper strip 4 which are joined together by gluing along gluing zones 5, 6 which extend along their longitudinal edges over a width of several millimetres. The second upper strip 4 of one tubular volume is glued by its outer face to the first lower strip 3' of the tubular volume immediately above. The joining of these strips 4, 3' is done in a central zone 7, elongated in the direction longitudinal to the strips, over a width of several millimetres. It is the same from the bottom of the blind to the top.

When the blind is raised, the successive strips 3, 4, 3' etc. are flat and tight against one another. When the blind is in the position of use, under the effect of the weight the strips 3, 4, 3' separate outside the zones of adhesion 5, 6, 7 etc. and the tubular volumes 2 appear. In this extended state of the blind the strips 3, 4, 3' etc. are in contact with one another solely by the zones of adhesion 5, 6, 7 . . . The strips 3, 4, 3' etc are obtained from sheets of plastics matter metallized on both opposite faces. The layer of metallization 8 has little thickness (50 microns, for example), but it is continuous in a conventional blind so that it establishes a continuity of thermal conductivity between the longitudinal edges of the zones of adhesion 5 (assumed in FIG. 1 to be next the inside environment I) and the opposite longitudinal edges of the zones of adhesion 6 (assumed in FIG. 1 to be next the outside environment E), on both faces of the strips 3, 4, 3' . . .

In accordance with the invention the strips 3, 4, 3' . . . which compose a blind are deprived of the metallic layer 8 in the gluing zones 5, 6, 7 from the side of the sheet where the adhesion is actually effected, but also on the opposite side, in other words, on both opposite faces of the sheet or the strip, over a width and a length at least equal to those of the gluing zones which are several millimetres wide, even along the longitudinal edges.

Figure 4:
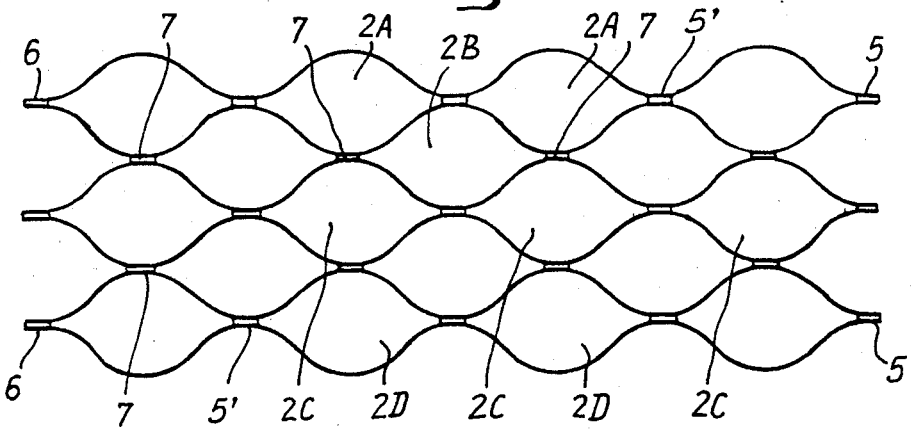
FIG. 4 s a partial diagrammatic view of a blind having a number of tubular volumes in succession in the horizontal direction.

FIG. 4 shows a blind in accordance with the invention which comprises a number of tubular volumes 2A, 2B, 2C, 2D, in the horizontal direction and in the vertical direction when the blind is being used; these volumes are obtained by gluing strips in gluing zones 5, 5', 6, 7 where each time there exists a break in the continuity on both faces of the strip as explained above.

Figure 2:
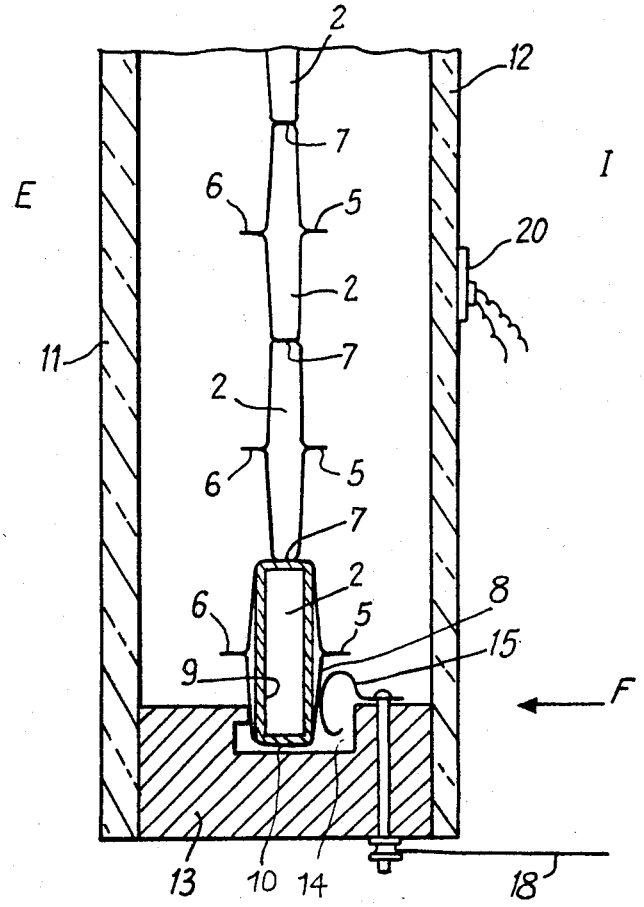
FIG. 2 is a section through a transverse plane of the bottom portion of a double-glazed frame containing a blind in accordance with the invention with one pair of electrical blades.

In FIG. 1 the metallic layer 8 has been greatly exaggerated. FIG. 2 shows a blind of the same species as that in FIG. 1, having only one row of tubular volumes 2 joined together in the vertical direction; the metallic layer does not appear, but it has been eliminated as in the blind from FIG. 1, before gluing along the gluing zones 5, 6, 7.

In this example each tubular volume 2 has in cross-section a configuration which is more rectangular than in the example from FIG. 1. The lowest tubular volume contains a loading bar 9 having a corresponding rectangular profile and preferably of material which is non-conductive of heat and of electricity; of course the lowest strip of the blind also exhibits a zone 10 of break in the continuity of the metallic layer on both opposite faces although there is no gluing zone on them. Hence on this lowest strip there exists a metallic coating 8 which extends over the whole length of this strip and only between the zone 10 of break in the continuity and the zone 5 for gluing to the next strip.

This blind is contained between two panes of glass, namely an outside pane 11 and an inside pane 12 assumed to be, the first next the outside E, the second next the inside I. Between the two panes of glass the frame (which is not shown completely) includes a bottom crossbar 13 of electrically insulating material. In the inner face of this crossbar 13 is arranged a seating 14 into which the lowest strip of the blind, made rigid by the loading bar 9, can penetrate partially. Into this seating 14 project two electrical contact spring blades 15, 16 which are joined respectively through the thickness of the crossbar 13, by two conductors 17, 18 to an electrical circuit comprising a thermostat 19 having a temperature detector 20 fixed to the inside pane 12. This circuit is connected to a source (not shown) of direct current at 24 volts. The two blades 15, 16 are spaced apart by a distance substantially equal to the width of the blind so that under the control of the thermostat 19 an electric current is made to flow in the metallic layer 8, which is capable of producing internal heating of the glazed frame to cancel the cold-wall effect as explained above.

It will be observed that it would be easy to mount the electrical blades 15, 16 on a movable insulating rod which could be moved by operating means passing through the thickness of the crossbar 13. Thus these blades 15, 16 might at will be put in contact with the blind or not.

We claim:

1. A double-glazed window frame for erection between an outside environment and an inside environment comprising a first glass pane adjacent said outside environment, a second glass pane adjacent said inside environment, and an internal blind, wherein said first glass pane and said second glass pane are parallel to one another and spaced apart by a predetermined width;

said internal blind is disposed parallel to and intermediate said first glass pane and said second glass pane;

said internal blind comprising a plurality of collapsible, elongated tubular volumes, each of said tubular volumes extending in a longitudinal direction, said tubular volumes being disposed in at least one row extending in a vertical direction, said vertical direction being transverse to said longitudinal direction, said blind being raisable and lowerable in said vertical direction;

each of said tubular volumes being bounded by longitudinally extending strips of plastic, each of said strips of plastic having a pair of opposed edges, one edge adjacent said first glass pane and the other edge adjacent said second glass pane, an upper face and a lower face;

said upper face and said lower face of each of said strips of plastic each having a metallic layer disposed thereon, each of said metalic layers having a longitudinally extending discontinuity disposed between said pair of opposed edges.

2. The frame as claimed in claim 1, wherein said longitudinally extending discontinuity of each of said metallic layers lies in a central zone of each of said strips.

3. The freame as claimed in claim 1, wherein each of said tubular volumes comprises a pair of strips of metallized plastic and are joined together along at least two longitudinally extending zones of adhesion, a longitudinally extending discontinuity in each of said metallic layers provided at each zone of said zones of adhesion on both faces of each of said strips of plastic.

4. The frames as claimed in claim 3, wherein said pair of strips are joined along longitudinally extending zones of adhesion of predetermined width disposed adjacent each of said pair of opposed edges of said pair of strips of plastic; and said longitudinally extending discontinuity in each of said metallic layers extends at least across said predetermined width of said zones of adhesion.

5. The frame as claimed in claim 1, further comprising at least one pair of electrical contact spring blades spaced apart in said longitudinal direction and contactable with at least one metallic layer disposed on one of said faces of one of said strips of plastic, said electrical contact spring blades forming a part of a low-voltage electrical circuit.

6. The frame as claimed in claim 5, wherein said electrical contact spring blades are disposed adjacent said second glass pane, whereby said electrical contact spring blades contact a metallic layer disposed on a face of one of said strips of plastic adjacent said second glass pane.

7. The frame as claimed in claim 5, wherein said low-voltage electrical circuit includes a thermostat with a temperature detector fixed to said second glass pane.

8. The frame as claimed in claim 5, wherein said electrical contact spring blades are movable relative to said internal blind and can be moved into and out of contact with said internal blind from a position external to said frame.

9. The frame as claimed in claim 5, wherein the lowest of said plurality of tubular volumes contains a loading bar of electrically insulating material and said frame further comprises a bottom crossbar in which is arranged a seating into which said electrical contact spring blades at least partially extend and into which said lowest of said plurality of tubular volumes partially descends when the blind is lowered.

10. A method of manufacture of an internal blind forming part of a double-glazed window frame as claimed in any one of claims 1, 2, 3, 4, 5, 6, 7, 8 or 9, comprising provided a sheet of plastic, having an upper face and a lower face, which has been coated by a metallic layer on each of said faces;

cutting strips of plastic from said sheet, said strips having a predetermined width and a predetermined length;

removing the metallic layer on each of said faces of each strip of plastic cut from said sheet in at least two predetermined zones of adhesion which extend lengthwise of said sheet;

joining said strips of plastic by aligning said at least two predetermined zones of adhesion with one another for each strip and then gluing adjacent sheets together along at least one of said aligned zones of adhesion.

* * * * *